US005955997A

United States Patent [19]

Ho et al.

[11] Patent Number: 5,955,997

[45] Date of Patent: Sep. 21, 1999

[54] MICROSTRIP-FED CYLINDRICAL SLOT ANTENNA

[75] Inventors: Chien H. Ho, Olathe; Paul K. Shumaker, Lenexa, both of Kans.

[73] Assignee: Garmin Corporation, Taiwan

[21] Appl. No.: 08/642,506

[22] Filed: May 3, 1996

[51] Int. Cl.[6] ..... H01Q 13/10; H01Q 1/38

[52] U.S. Cl. ..... 343/767; 343/770; 343/895

[58] Field of Search ..... 343/767, 770, 343/895; H01Q 1/36, 1/38, 11/08, 13/10

[56] References Cited

U.S. PATENT DOCUMENTS

| | | | |
|---|---|---|---|
| 2,665,381 | 1/1954 | Smith et al. | 343/770 |
| 2,877,427 | 3/1959 | Butler | 343/770 |
| 4,012,744 | 3/1977 | Greiser | 343/895 |
| 4,297,707 | 10/1981 | Brunner et al. | 343/770 |
| 4,451,830 | 5/1984 | Lucas et al. | 343/768 |
| 4,612,543 | 9/1986 | De Vries | 342/187 |
| 4,675,691 | 6/1987 | Moore | 343/908 |
| 4,843,403 | 6/1989 | Lalezari et al. | 343/767 |
| 5,068,670 | 11/1991 | Maoz | 343/767 |
| 5,200,757 | 4/1993 | Jairam | 343/786 |
| 5,216,430 | 6/1993 | Rahm et al. | 343/700 MS |
| 5,255,005 | 10/1993 | Terret et al. | 343/895 |
| 5,353,040 | 10/1994 | Yamada et al. | 343/895 |
| 5,427,032 | 6/1995 | Hiltz et al. | 343/720 |

*Primary Examiner*—Michael C. Wimer
*Attorney, Agent, or Firm*—Shook, Hardy & Bacon, L.L.P.

[57] ABSTRACT

A microstrip-fed cylindrical slot antenna is provided for allowing better communication between an object and a satellite. The microstrip-fed cylindrical slot antenna comprises a cylindrical base member; a first conductive coating disposed on the cylindrical base member; at least one slot disposed in the conductive coating, the slot having a helical configuration about the cylindrical base member; and a feed line corresponding to each of the slots, the feed line crossing each respective slot and extending beyond the slot by a distance D.

40 Claims, 5 Drawing Sheets

MICROSTRIP-FED CYLINDRICAL SLOT ANTENNA

BACKGROUND OF THE INVENTION

1. Field of the Invention

The present invention relates generally to L band communications satellite system antennas such as that used in a Global Positioning System (GPS), INMARSAT, MSAT, PROSAT, NAVSTAR, etc.; and more particularly to a microstrip-fed cylindrical slot antenna for use in these systems.

2. Description of the Prior Art

The evolution of satellite communication networks has proceeded from the design and development stage to actual working systems within the last decade. The Global Positioning System (GPS) is one of the major accomplishments realized in systems utilizing satellite communication.

One area in which these GPS systems are utilized is in aircraft avionics. The commercial GPS user equipment for aircraft networks requires an antenna that can provide a right-hand circular polarization and a uniform pattern coverage over approximately the entire upper hemisphere. The uniform amplitude response over a wide coverage region allows the receiver to maintain signal lock to satellites with a useful signal-to-noise ratio. Because a high-speed aircraft constantly changes its look angle to satellites, the wide beamwidth coverage allows the receiver to track as many of the visible satellites as possible and maintain the system's proper Geometric Dilution of Precision (GDOP). Also, a mechanical configuration that has no appreciable drag and requires no elaborate structural modification to the aircraft is another leading concern of airborne terminal in a satellite-to-air communication link. Slot antennas are useful in applications where low-profile or flush installations are required on a high-dynamic aircraft.

The slotted cylinder antenna was first introduced by Andrew Alford in an article entitled "Long Slot Antennas," *Proc. Natl. Electronics Conf.,* p. 143, 1946. The physical structure of the slotted cylinder antenna proposed by Alford consists of a slotted sheet metal bent into a cylinder. He described this type of vertical slotted cylinder as a resonant transmission line with a sufficient number of shunt loops. FIG. 1 shows the physical configuration of the conventional slotted cylinder antenna. As shown in FIG. 1, the antenna is formed by bending a slotted sheet metal into a cylinder 10. It should be appreciated that most of the current flows in the horizontal loops 12 around the cylinder due to the sufficiently low impedance of a circumference path around cylinder 10. A coaxial feed 14 is provided for delivering current to a radiating slot 16 as illustrated in FIG. 1. The antenna radiates a horizontally polarized field with a nearly circular pattern in the horizontal plane. This type of vertical slot antenna is suitable for broadcasting a horizontally polarized wave with an omnidirectional or circular pattern in the horizontal plane.

Cylindrical antennas have been disclosed in the prior art. For example, U.S. Pat. No. 5,353,040, by Yamada et al., discloses a four wire cylindrical antenna and a four wire stepped cylindrical antenna for use in an aircraft. Yamada clearly states that the four wire cylindrical antenna is not sufficiently broad enough for simultaneous transmission and reception through different frequency bands. This problem was overcome by Yamada by providing a step between two cylindrical antennas having different circumferences and being coaxially located. It should be appreciated that this antenna structure does not disclose a slot disposed through the cylinder.

U.S. Pat. No. 5,255,005, by Terret et al., discloses a four wire cylindrical quadrifilar helix antenna formed by two bifilar helices. As may be seen in FIG. 1, of the patent each of these helices have different diameters. Each wire, which forms a respective helix, is between $\lambda/2$ and $\lambda$ in length. It should be appreciated that this antenna structure does not disclose a slot disposed through the cylinder.

U.S. Pat. No. 5,200,757, by Jairam, discloses a cylindrical antenna having a number of parallel sided slots which extend at an angle of 45° to the horn axis. These slots do not extend along the entire length of the cylinder.

U.S. Pat. No. 5,427,032, by Hiltz et al., discloses the use of a cylindrical antenna for receiving radio signals from a remote source.

U.S. Pat. No. 4,675,691, by Moore, discloses a cylindrical antenna having at least one slot disposed along the length of the cylinder as illustrated in FIG. 4.

U.S. Pat. No. 4,451,830, by Lucas et al. discloses an antenna comprising a cylindrical radiator which is formed with four orhtogonally disposed longitudinally extending slots. Each slot is backed by a separate cavity which extends into the cylinder.

U.S. Pat. No. 4,012,744, by Greiser, discloses a circularly polarized broad beam antenna system comprising a cylindrical antenna having a bifilar helix. The antenna has a planar portion which is coupled to the bifilar helix.

The radiation properties of the microstrip-fed slot antennas were first reported by Yashimura in an article entitled "A Microstrip Slot Antenna," *IEEE Trans. Microwave Theory Tech.,* vol. MTT-20, pp. 760–762, Nov. 1972. He measured the input impedances and the radiation patterns for various geometries of microstrip-fed slot antennas. The physical structures of these slot antennas are fabricated by simple and conventional photoetching techniques and considered to be suitable for Monolithic Integrated Circuits (MIC) and Microwave Monolithic Integrated Circuit (MMIC) transceivers. They also have the advantages of being able to produce bidirectional and unidirectional radiation patterns and requiring very simple feeding and matching techniques. FIG. 2 shows the physical structure of this prior art microstrip-fed slot antenna. As shown in FIG. 2, the longer sides L of the radiating slot 18 are perpendicular to a microstrip feed line 20. The microstrip feed line 20 crosses radiating slot 18 and is short-circuited through a dielectric substrate 22. A microstrip ground 24 is disposed on dielectric substrate 22. The slot radiator can be excited either from its center or at a distance from its center. The center-fed slot antenna requires a matching circuit to match the input impedance of radiating slot 18 to the 50 Ω microstrip feed line 20. The microstrip-fed slot antenna may be modeled by a loaded transmission line.

FIG. 3 shows the equivalent circuit of the microstrip-fed slot antenna in FIG. 2. Radiating slot 18 is modeled by two short-circuited slot lines 26,28 which are loaded with a radiation resistance $R_s$, representing radiated power from radiating slot 18. A magnetic coupling between microstrip feed line 20 and radiating slot 18 is modeled by a transformer 30. It should be appreciated that the values of turn ratio n and mutual coupling coefficient M are crucial in the determination of the input impedance. Transformer 30 is the electrical equilivent of dielectric substrate 22.

Microstrip antennas have been disclosed in the prior art. For example, U.S. Pat. No. 5,216,430, by Rahm et al., discloses a low impedance printed circuit radiating element and U.S. Pat. No. 4,612,543, by De Vries, discloses a cylindrical microstrip fed antenna mounted on a cylinder.

SUMMARY OF THE INVENTION

It is therefore an object of the present invention to provide a microstrip-fed cylindrical slot antenna which will provide a right-hand circular polarization and a uniform pattern coverage over approximately the entire upper hemisphere.

It is a further object to provide a microstrip-fed cylindrical slot antenna which has a mechanical configuration that has no appreciable drag and needs no elaborate structural modification to an aircraft.

It is yet another object to provide a microstrip-fed cylindrical slot antenna which provides compact size, low cost, ease of mass production, near-hemispherical radiation coverage, and circular polarization properties.

It is yet another object to provide a microstrip-fed cylindrical slot antenna having a 3 dB beamwidth of more than 120° and a front-back ratio of more than 15 dB.

It is yet another object to provide a microstrip-fed cylindrical slot antenna that avoids the need for introducing complex matching means between the antenna and its excitation.

In all of the above embodiments, it is an object to provide a microstrip-fed cylindrical slot antenna having a low-profile or flush installation on a high-dynamic aircraft.

Finally, it is an object of the invention to provide a microstrip-fed cylindrical slot antenna having fairly good circular polarization, radiation pattern, front-to-back ratio, and wide beamwidth.

According to one broad aspect of the present invention, there is provided a half-wavelength microstrip-fed cylindrical slot antenna. The design technique employs four ¾ turn cylindrical slots etched in the ground plane of four 90° differential-fed microstrip lines. The phase quadrature between the microstrip feed lines excites a circularly polarized wave.

According to another broad aspect of the invention, there is provided a quarter-wavelength microstrip-fed cylindrical slot antenna. This cylindrical slot antenna consisting of four ½ turn microstrip-fed cylindrical slots.

Other objects and features of the present invention will be apparent from the following detailed description of the preferred embodiment.

BRIEF DESCRIPTION OF THE DRAWINGS

The invention will be further described in conjunction with the accompanying drawings, in which.

DETAILED DESCRIPTION OF THE PREFERRED EMBODIMENT

Figure 1:
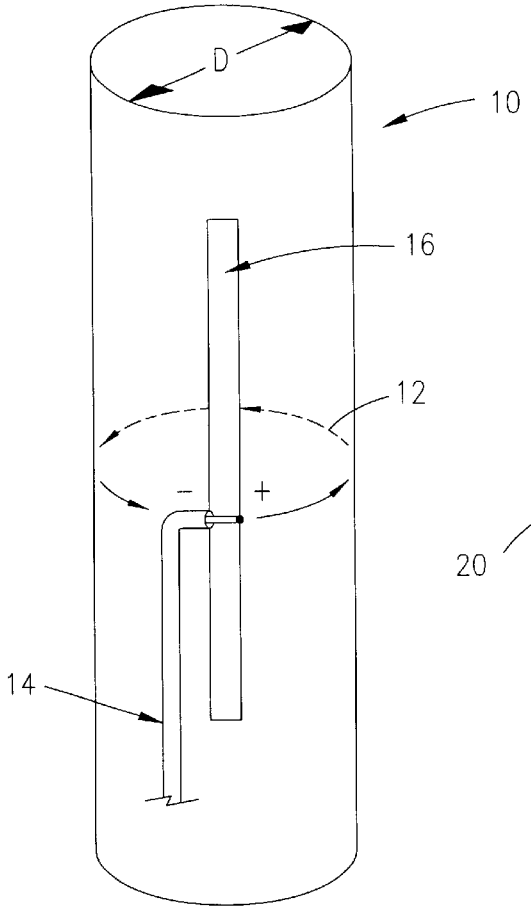
Fig. 1. (PRIOR ART)
FIG. 1 is a perspective view of a prior art cylindrical slot antenna.
Figure 2:
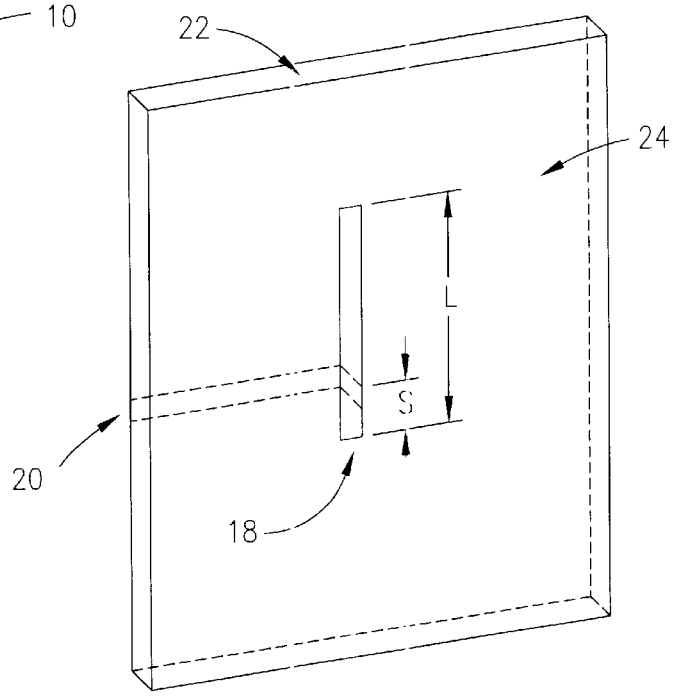
Fig. 2. (PRIOR ART)
FIG. 2 shows the physical structure of a prior art microstrip-fed slot antenna.
Figure 3:
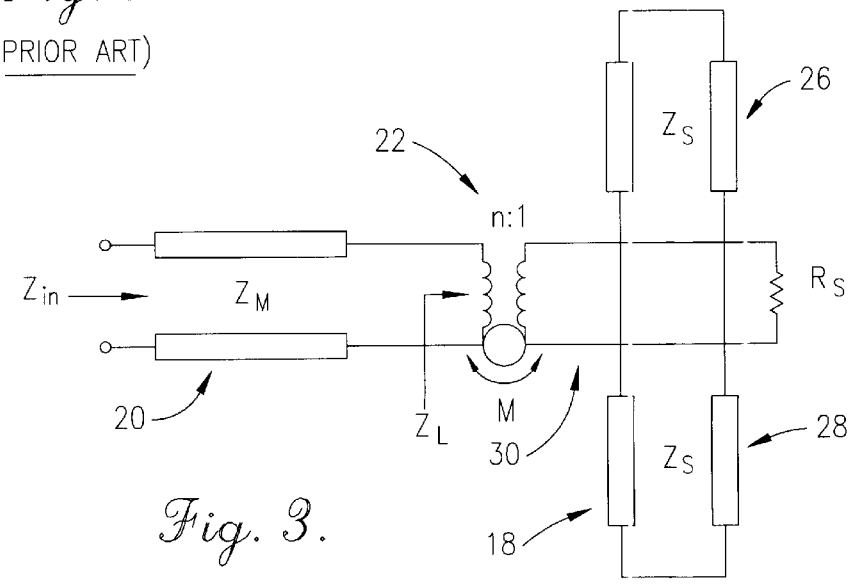
FIG. 3 illustrates an equivalent circuit of the prior art microstrip-fed slot antenna in FIG. 2.
Figure 5:
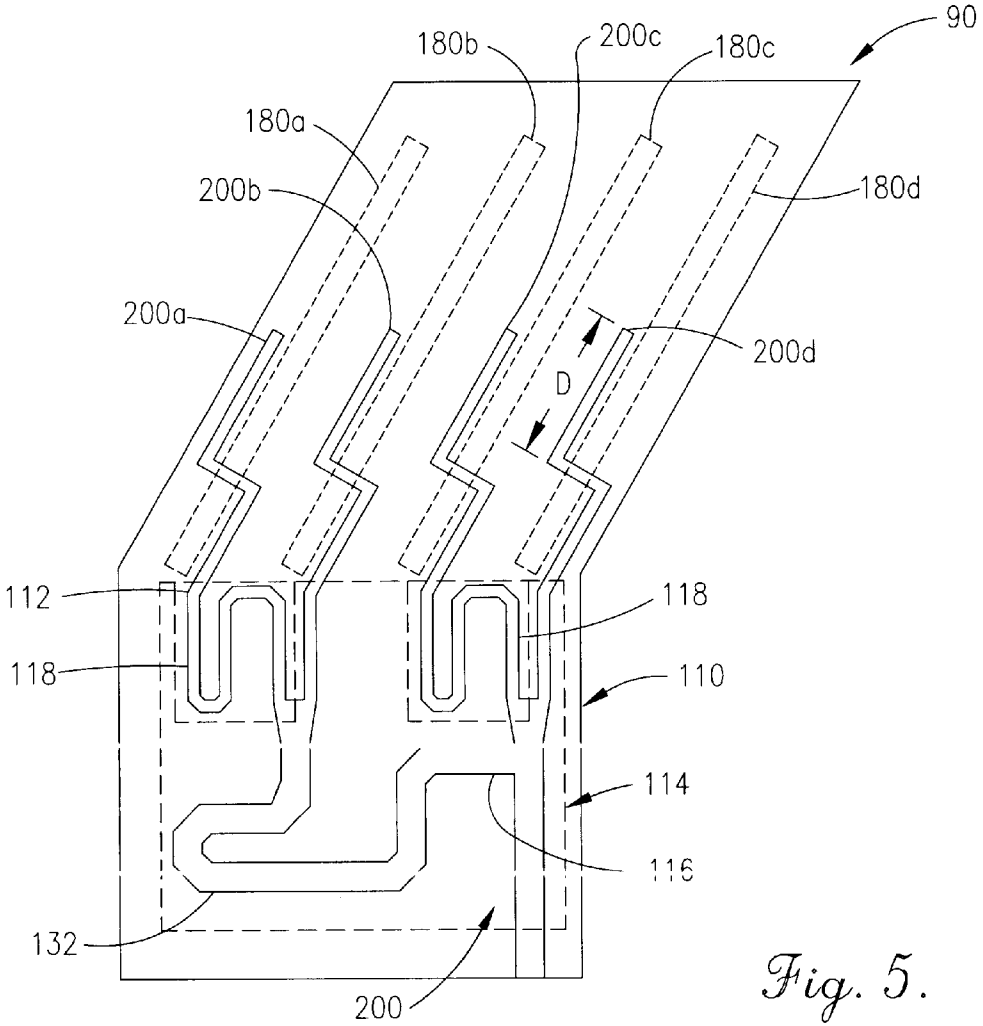
FIG. 5 illustrates a feeding network for the half-wavelength cylindrical slot antenna of FIG. 4.
Figure 4:
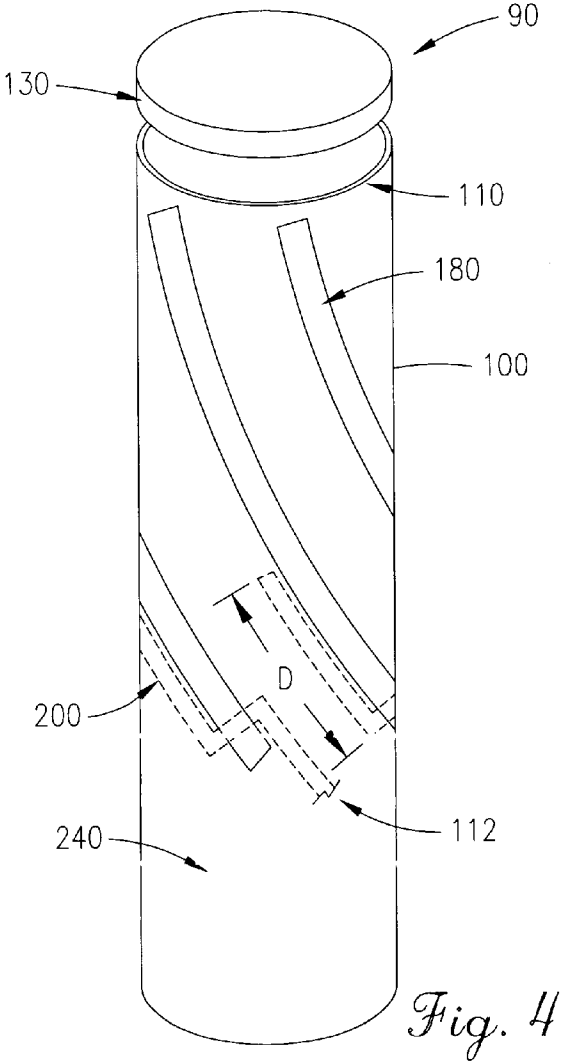
FIG. 4 shows a printed half-wavelength cylindrical slot antenna which is constructed in accordance with a preferred embodiment of the invention.

With reference to the Figures, wherein like reference characters indicate like elements throughout the several views and, in particular, with reference to FIG. 4, a printed half-wavelength cylindrical slot antenna 90 utilizing microstrip baluns is provided. As may be seen, the antenna 90 comprises a cylindrical structure 100 formed from a Kapton laminate 110. Kapton is a registered trademark of E. I. Du Pont Nemours and Company. Disposed on laminate 110 is a ground plane 240. As may be seen from FIGS. 4 and 5, four radiating slots are disposed through ground plane 240 and laminate 110. A short circuit cap 130 is provided at the top of cylindrical structure 100 and provides electrical connection of ground plane 240 over cap 130. A hybrid circuit is connected to each microstrip feed line as illustrated in FIG. 5, at cut line 112 in FIG. 4. For convenience, each miscrostrip feed line is generically referenced as element 200 and specifically assigned a letter such as a, b, c or d.

Each of the radiating slots 180 in FIG. 4 is etched in ground plane 240 of the respective microstrip feed lines 200 in a helical fashion on the surface of cylinder 100. For convenience, each radiating slot is generically referenced as element 180 and specifically assigned a letter such as a, b, c or d. The width of each radiating slot 180 is preferably 100 mils. It should be appreciated that the etching of radiating slots 180 may be accomplished by a conventional lithographic technique. Each microstrip feed line 200 crosses a respective radiating slot 180 at a right angle, takes an approximately 90° turn and then extends a distance D generally parallel respective slot 180. In a preferred embodiment, this distance D is about one quarter-wavelength of the system. Unlike the slotted cylinder antenna proposed by the prior art, each of the four vertical slots in FIG. 4 is rolled, in a helical fashion, by ¾ turn around cylindrical structure 100

This resonant quadrifilar structure is to provide the right-hand circular polarization and increase the radiation coverage in the horizontal plane. At the feed point, the center conductor of microstrip line 200 extends about one quarter-wavelength along the respective radiating slot 180 and ends with an open circuit. This transition causes balanced currents to flow on both sides of each radiating slot 180 and has less effect on the impedance transformation. Therefore, the input impedance of each radiating slot may be matched to a 50 Ω microstrip feed line by a minor adjustment of the length ratio between two short-circuited ends.

Turning now to FIG. 5, the 90° phase relationship between the four radiating slots may be achieved by using a microstrip feeding network 114. The choice of feeding network 114 may be hybrid types such as branch line or ratrace coupler, or T-splitters of either matched or unmatched form. Feeds using hybrid couplers and matching T-splitters incorporate a fourth port with an absorbing load. Though these three types of feeding networks have good isolation between the output ports, using the add-on component reduces the basic simplicity of the printed construction. To reduce the complexity of fabrication and assembly, the use of a non-isolating inline power splitter with an excess quarter-wavelength line in one output arm to generate the required 90° phase differentials between the radiating slots 180 is preferred. As may be seen in FIG. 5, a T-splitter 116 is provided between microstrip line 200 and feeds 200*c* and 200*d*. There is provided a delay line 118 between feeds 200*c* and 200*d*. A similar delay line 118 is provided between feeds 200*a* and 200*b*. Attached to the distal end of T-splitter 116 is another delay line 132 which provides the required 180° phase differentials between radiating slots 180*a* and 180*c* as well as 180*b* and 180*d*.

Figure 6:
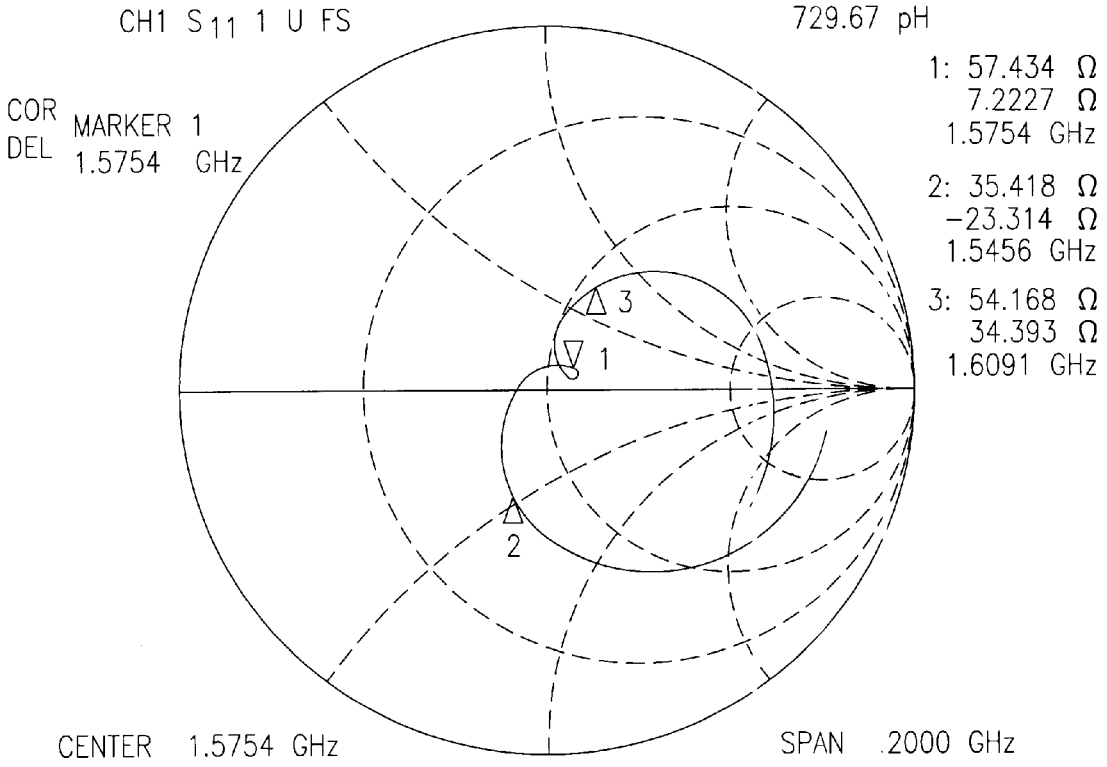
FIG. 6 shows the measured frequency response of input impedance for the microstrip-fed cylindrical slot antenna of FIG. 4.

FIG. 6 shows the measured frequency response of input impedance for a microstrip-fed cylindrical slot antenna. As shown in FIG. 6, antenna 90 is resonant at 1.5754 GHz with input impedance of 57.4+j7.2 Ω. The return loss at the center frequency is greater than 20 dB. The bandwidth with 10 dB return loss is about 4% of the center frequency. The input impedance was measured at the input terminal of microstrip feeding network 114 by using an HP8719A vector network analyzer.

Figure 7:
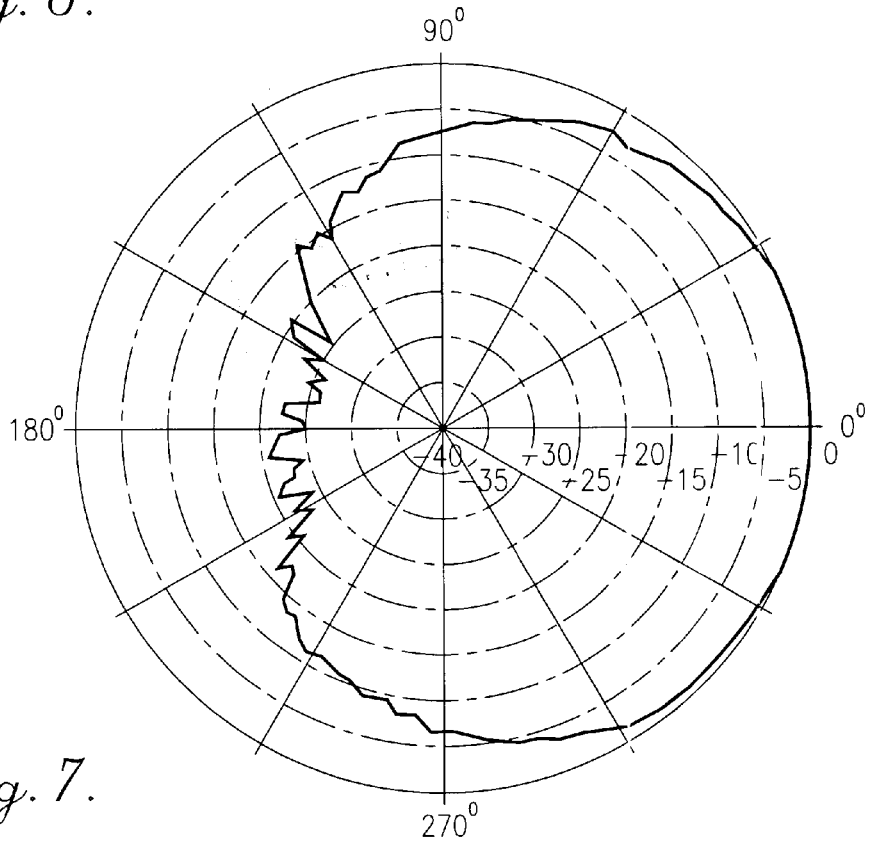
FIG. 7 illustrates the radiation pattern of the printed half-wavelength cylindrical slot antenna of FIG. 4.

FIG. 7 shows the radiation pattern of the printed half-wavelength cylindrical slot antenna. As shown in FIG. 7, the half power beamwidth is more than 130° and the front-back ratio is more than 20 dB, which is fairly good for the resistance of multipath signals from the ground. The radiation pattern was measured by using an HP8719A vector network analyzer with a calibrated right-hand circularly polarized helical antenna.

A field test for verifying the half-wavelength cylindrical slot antenna was conducted using a Garmin's GPS90™ receiver. The test was under a satellite geometry with Position Dilution of Precision (PDOP) of 59 feet. The receiver bar graph illustrated that satellites 1, 15, 20, 21, and 25 located within the axis angle of θ=±45° have calibrated signal scales of 9, 9, 8, 8, and 9, which corresponds to the receiver phase noise of 51 dB, 51 dB, 49 dB, 49 dB, and 51 dB, respectively. Satellites 5, 14, and 22 located outside the axis angle of θ=±45° have calibrated signal scales of 6, 7, and 8, which corresponds to the receiver phase noise of 45 dB, 47 dB, and 49 dB, respectively. According to the test results, the radiation pattern coverage of the half-wavelength cylindrical slot antenna allows the GPS receiver to track satellites at very low elevation angles. Though the half-wavelength cylindrical slot antenna has a fairly good electrical performance, the antenna size can be further reduced by applying quarter-wavelength radiating slots.

Turning now to the second embodiment of the invention, like elements have been provided with like reference numerals except that a prime has been added to each reference numeral. The following discussion will focus on the differences between elements of this embodiment and that of the preferred embodiment.

The primary difference in this embodiment is that quarter-wavelength slots are utilized in place of the half-wavelength slots discussed above.

Figure 8:
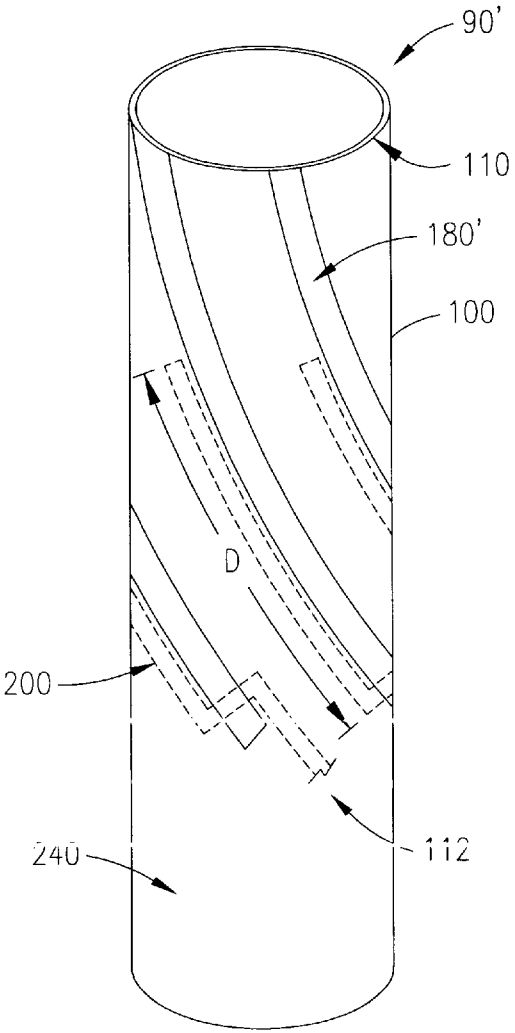
FIG. 8 shows a printed quarter-wavelength cylindrical slot antenna which is constructed in accordance with a preferred embodiment of the invention.

FIG. 8 shows the printed quarter-wavelength cylindrical slot antenna 90'. Each of the four radiating slots 180' is rolled by one half turn around cylindrical structure 100. Each microstrip feed line 200 crosses a respective radiating slot 180 at a right angle, takes an approximately 90° turn and then extends a distance D generally parallel respective slot 180. In a preferred embodiment, this distance D is about one quarter-wavelength of the system. The width of each radiating slot 180' is preferably 100 mils. A similar microstrip feeding network 114 with four quarter-wavelength radiating slots 180, as illustrated in FIG. 5, is utilized with antenna 90'.

Figure 9:
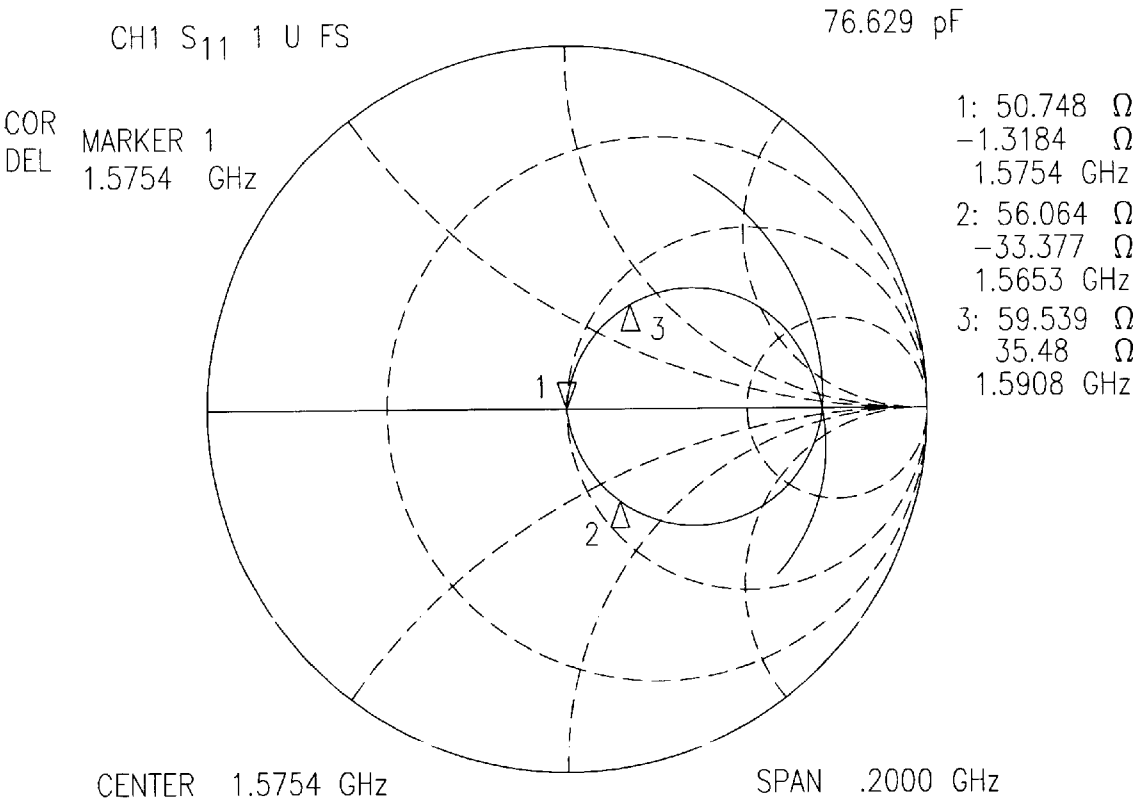
FIG. 9 shows the measured frequency response of input impedance for the microstrip-fed cylindrical slot antenna of FIG. 8.
Figure 10:
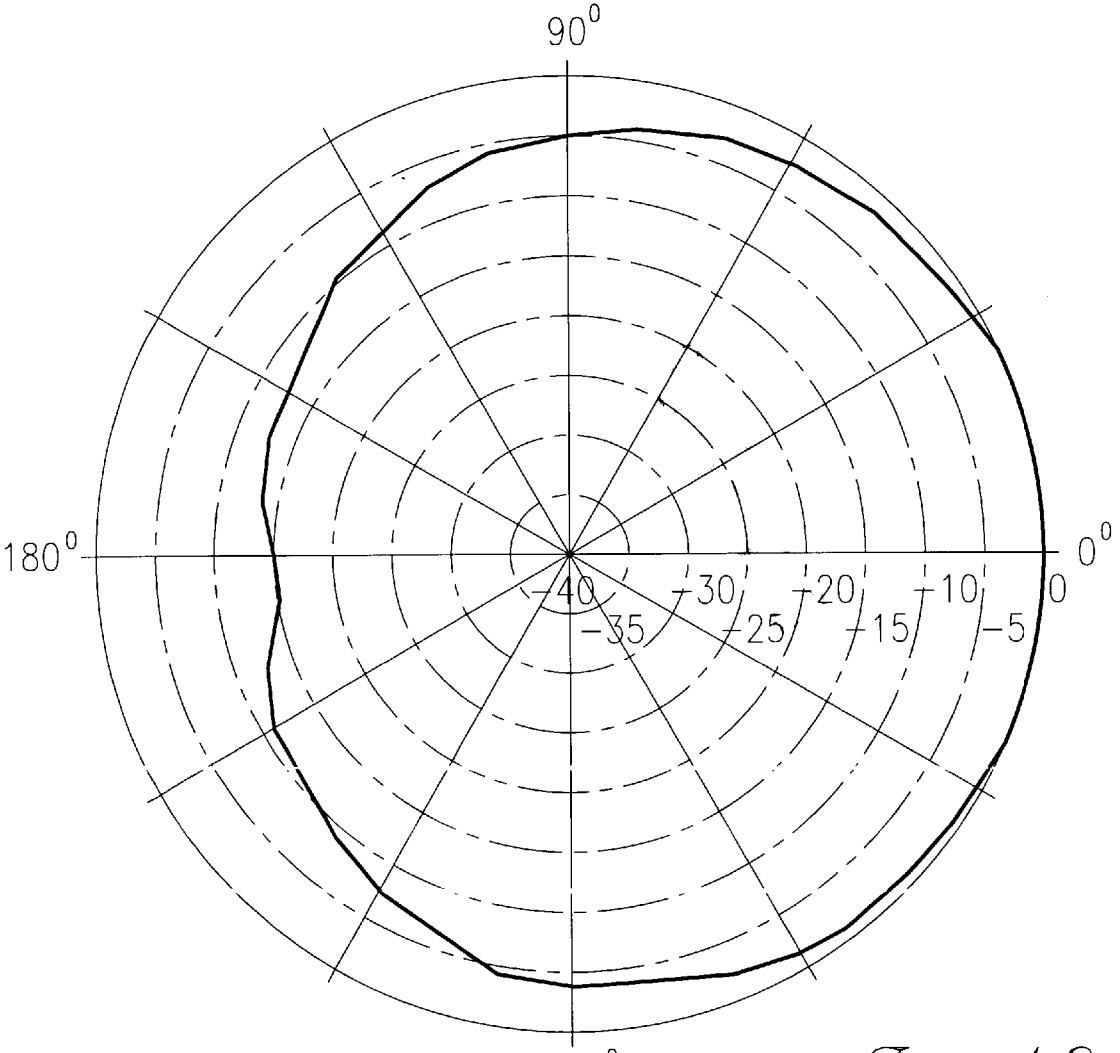
FIG. 10 illustrates the radiation pattern of the printed quarter-wavelength cylindrical slot antenna of FIG. 8.

FIG. 9 shows the measured frequency response of input impedance for a quarter-wavelength cylindrical slot antenna. As shown in FIG. 9, the antenna is resonant at 1.5754 GHz with input impedance of 50.7−j1.3 Ω. The return loss at the center frequency is greater than 30 dB and the bandwidth with 10 dB return loss is about 1.5% of the center frequency. FIG. 10 shows the radiation pattern of the quarter-wavelength cylindrical slot antenna. The half power beamwidth is more than 120° and the front-back ratio is more than 15 dB.

A field test for verifying the quarter-wavelength cylindrical slot antenna was conducted by using a Garmin's GPS90™ receiver. The test was under a satellite geometry with Position Dilution of Precision (PDOP) of 69 feet. The receiver bar graph shows that satellites 1, 15, 20, 21, and 25 located within the axis angle of θ=±45° have calibrated signal scales of 9, 9, 8, 8, and 9, which corresponds to the receiver phase noise of 51 dB, 51 dB, 49 dB, 49 dB, and 51 dB, respectively. Satellites 5, 14, and 22 located outside the axis angle of θ=±45° have calibrated signal scales of 6, 7, and 8, which corresponds to the receiver phase noise of 45 dB, 47 dB, and 49 dB, respectively.

In addition to the electrical characteristics the quarter-wavelength cylindrical slot antenna is mechanically desirable as well. Its cylindrical dimensions are about ½ inch in diameter by 1½ inches long. The weight including the supporting base and radome is about 1 ounce.

While the above description has focused on GPS systems, it should be appreciated that this inventive concept may be utilized in any type of system where it is desirable to have a right-hand circular polarization and a uniform pattern coverage over approximately the entire upper hemisphere. These systems include INMARSAT, MSAT, PROSAT, and NAVSTAR but are not limited to these systems. Additionally, it should be appreciated that systems functioning in other than the L band may utilize the teachings of the present invention.

Although the present invention has been fully described in connection with the preferred embodiment thereof with reference to the accompanying drawings, it is to be noted that various changes and modifications are apparent to those skilled in the art. Such changes and modifications are to be understood as included within the scope of the present invention as defined by the appended claims, unless they depart therefrom.

What is claimed is:

1. A microstrip-fed cylindrical slot antenna structure comprising:

a cylindrical base member;

a first conductive coating disposed on said cylindrical base member;

a slot disposed in said conductive coating, said slot having a helical configuration about said cylindrical base member; and a feed line corresponding to said slot, said feed line crossing said slot in a perpendicular manner and then extending along said slot a distance D in a corresponding helical relationship.

2. The antenna of claim 1, wherein said cylindrical base member comprises a dielectric material.

3. The antenna of claim 1, wherein said cylindrical base member comprises a laminate.

4. The antenna of claim 1, wherein said first conductive coating is connected to an electrical ground and thus forms a ground plane.

5. The antenna of claim 1, further comprising a cap member disposed on a distal end of said cylindrical base member, said cap member having a second conductive coating in electrical communication with said first conductive coating.

6. The antenna of claim 1, wherein said feed line is an electrical open circuit.

7. The antenna of claim 1, wherein said distance D is less than λ, where λ is the wavelength of a signal received by said antenna.

8. The antenna of claim 1, wherein said distance D is less than or equal to λ/4, where λ is the wavelength of a signal received by said antenna.

9. The antenna of recited in claim 1, wherein said slot is less than or equal to 100 mils wide.

10. The antenna recited in claim 1, wherein said slot having a helical configuration is rolled less than one full turn.

11. The antenna recited in claim 1, wherein said slot having a helical configuration is rolled by ¾ of a full turn.

12. The antenna recited in claim 1, wherein said slot having a helical configuration is rolled by ½ of a full turn.

13. The antenna recited in claim 1, further comprising a feeding network for feeding said feed line before crossing said respective slot.

14. The antenna of claim 13, wherein said feeding network comprises elements selected from the group consisting of: branch lines, retrace couplers, matched T-splitters and unmatched T-splitters.

15. The antenna recited in claim 1, wherein there are at least four slots having a helical configuration about said cylindrical base member.

16. A microstrip-fed cylindrical slot antenna structure comprising:

a cylindrical base member;

a first conductive coating disposed on said cylindrical base member;

a slot disposed in said conductive coating, said slot having a helical configuration about said cylindrical base member, said slot having a helical configuration being rolled less than one full turn; and a feed line corresponding to said slot, said feed line crossing said slot in a perpendicular manner and then extending along said slot a distance D in a corresponding helical relationship, said distance D being less than λ, where λ is the wavelength of a signal received by said antenna structure.

17. The antenna of claim 16, wherein said cylindrical base member comprises a dielectric material.

18. The antenna of claim 16, wherein said cylindrical base member comprises a laminate.

19. The antenna of claim 16, wherein said first conductive coating is connected to an electrical ground and thus forms a ground plane.

20. The antenna of claim 16, wherein said feed line is an electrical open circuit.

21. The antenna of claim 16, wherein said distance D is less than or equal to λ/4, where λ is the wavelength of a signal received by said antenna.

22. The antenna of recited in claim 16, wherein said slot is less than or equal to 100 mils wide.

23. The antenna recited in claim 16, wherein said slot having a helical configuration is rolled by ¾ of a full turn.

24. The antenna recited in claim 16, wherein said slot having a helical configuration is rolled by ½ of a full turn.

25. The antenna recited in claim 16, further comprising a feeding network for feeding said feed lines before crossing said respective slot.

26. The antenna of claim 25, wherein said feeding network comprises elements selected from the group consisting of: branch lines, retrace couplers, matched T-splitters and unmatched T-splitters.

27. The antenna recited in claim 16, wherein there are at least four slots having a helical configuration about said cylindrical base member.

28. A half-wavelength microstrip-fed cylindrical slot antenna structure comprising;

a cylindrical base member;

a first conductive coating disposed on said cylindrical base member;

a slot disposed in said conductive coating, said slot having a helical configuration about said cylindrical base member, said slot having a helical configuration being rolled by ¾ of a full turn;

a feed line corresponding to said slot, said feed line crossing said slot in a perpendicular manner and then extending along said slot a distance D in a corresponding helical relationship, said distance D is less than or equal to λ/4, where λ is the wavelength of a signal received by said antenna structure; and a feeding network for feeding said feed line before crossing said slot.

29. The antenna of claim 28, wherein said cylindrical base member comprises a dielectric material.

30. The antenna of claim 28, wherein said cylindrical base member comprises a laminate.

31. The antenna of claim 28, wherein said first conductive coating is connected to an electrical ground and thus forms a ground plane.

32. The antenna of claim 28, further comprising a cap member disposed on a distal end of said cylindrical base member, said cap member having a second conductive coating in electrical communication with said first conductive coating.

33. The antenna of claim 28, wherein said feed line is an electrical open circuit.

34. A quarter-wavelength microstrip-fed cylindrical slot antenna structure comprising;

a cylindrical base member;

a first conductive coating disposed on said cylindrical base member;

a slot disposed in said conductive coating, said slot having a helical configuration about said cylindrical base member, said slot having a helical configuration being rolled by ½ of a full turn;

a feed line corresponding to said slot, said feed line crossing said slot in a perpendicular manner and then extending along said slot a distance D in a corresponding helical relationship, said distance D is less than or equal to λ/4, where λ is the wavelength of a signal received by said antenna structure; and a feeding network for feeding said feed line before crossing said slot.

35. The antenna of claim 34, wherein said cylindrical base member comprises a dielectric material.

36. The antenna of claim 34, wherein said cylindrical base member comprises a laminate.

37. The antenna of claim 34, wherein said first conductive coating is connected to an electrical ground and thus forms a ground plane.

38. The antenna of claim 34, wherein said feed line is an electrical open circuit.

39. The antenna of recited in claim 34, wherein said slot is less than or equal to 100 mils wide.

40. The antenna of claim 34, wherein said feeding network comprises elements selected from the group consisting of: branch lines, retrace couplers, matched T-splitters and unmatched T-splitters.

* * * * *